United States Patent [19]

Tezuka

[11] 4,325,019

[45] Apr. 13, 1982

[54] CURRENT STABILIZER

[75] Inventor: Hideharu Tezuka, Yokosukashi, Japan

[73] Assignee: Tokyo Shibaura Denki Kabushiki Kaisha, Kawasaki, Japan

[21] Appl. No.: 188,661

[22] Filed: Sep. 19, 1980

[30] Foreign Application Priority Data

Oct. 3, 1979 [JP] Japan ..... 54-127792

[51] Int. Cl.[3] ..... G05F 3/20

[52] U.S. Cl. ..... 323/315; 307/296 R

[58] Field of Search ..... 307/296; 323/312, 315, 323/316, 317; 330/288

[56] References Cited

U.S. PATENT DOCUMENTS

| | | | |
|---|---|---|---|
| 3,721,893 | 3/1973 | Davis | 323/317 |
| 3,911,353 | 10/1975 | van de Plassche | 323/315 |
| 4,172,992 | 10/1979 | Culmer et al. | 323/316 |

FOREIGN PATENT DOCUMENTS

| | | | |
|---|---|---|---|
| 550627 | 5/1977 | U.S.S.R. | 323/315 |

OTHER PUBLICATIONS

Wurzburg, Henry, "Floating Regulator Gives 0.1% Regulation Over 0-to-100-V-DC, 200 MA Range", Electronic Design 19, Sep. 13, 1975.

Hart, B. L., Barker, R. W. J., "The Design of Constant Current Sources", Electronic Engineering, Jun. 1977, pp. 85-87.

*Primary Examiner*—William M. Shoop

*Attorney, Agent, or Firm*—Cushman, Darby & Cushman

[57] ABSTRACT

A current stabilizer has a current mirror including first and second terminals through which first and second currents flow. A transistor circuit including a transistor and a resistor is connected to the first terminal so as to cause the first current to flow therein, which first current defines the current which may flow through the second terminal. The biasing of the transistor is selected with respect to the temperature coefficients of the transistor and resistor so that the first current remains constant and temperature independent.

4 Claims, 3 Drawing Figures

CURRENT STABILIZER

BACKGROUND OF THE INVENTION

This invention relates to a current stabilizing circuit and more particularly to such a circuit particularly suited for integration.

BACKGROUND OF THE PRIOR ART

Current sources which provide an accurately adjustable constant current are required for numerous purposes. Such current sources may, for example, be used as the power supply for integrated circuits. To realize a constant current, the current source must be independent of temperature variation.

A current mirror, including a pair of identical transistors, known per se, is often used in a current source because currents derived from a current mirror are determined almost exclusively by the emitter areas of transistors used. However, such conventional current sources are not independent of temperature variations.

SUMMARY OF THE INVENTION

The present invention is an improved current stabilizing circuit which is highly temperature independent with the additional advantage that the circuit consists of few components and is easily integrated.

DETAILED DESCRIPTION OF THE PREFERRED EMBODIMENTS

Figure 1:
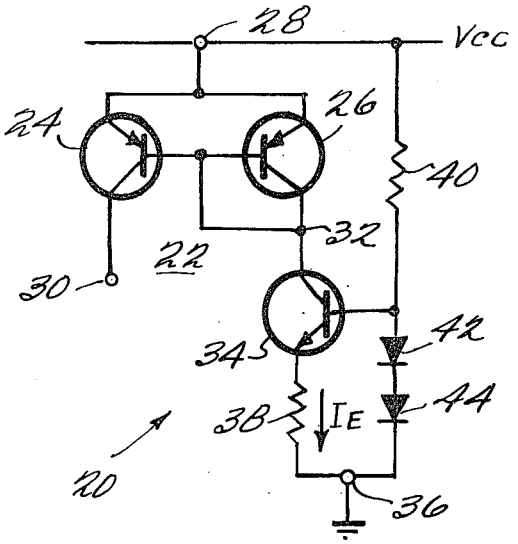
Fig. 1 (PRIOR ART)
FIG. 1 is a circuit diagram of a conventional current source.

Referring now to FIG. 1, a conventional current source will be described. Conventional current source 20 includes a current mirror 22 having a pair of identical p-n-p transistors 24 and 26. Current mirror 22 has terminals 30 and 32, and a sum terminal 28 from the emitters of transistors 24 and 26 which is connected to a power source $V_{cc}$. The base of transistor 24 is connected to the base of transistor 26. Transistor 26 operates as a diode in that its base and collector are interconnected. The collector of transistor 26 is connected to terminal 32 so that the emitter-collector path of transistor 26 constitutes a current path between terminals 28 and 32. Similarly, the emitter-collector path of transistor 24 constitutes a current path between terminals 28 and 30.

Terminal 32 is connected to a n-p-n transistor 34, specifically to the collector thereof. The emitter of transistor 34 is connected to ground terminal 36 through a resistor 38.

Between power source $V_{CC}$ and the base of transistor 34, a resistor 40 is connected. Serially connected diodes 42 and 44 are connected between the base of transistor and ground terminal 36.

In the conventional current source described above and illustrated in FIG. 1, a first current through the emitter of transistor 34, designated $I_E$, is expressed by the following equation:

$$I_E=(2V_F-V_{BE})/R_{38} \quad (1)$$

where $V_F$ is the forward voltage drop of each of diodes 42 and 44, $V_{BE}$ is base-emitter voltage of transistor 34, and $R_{38}$ is the value of resistor 38.

If the forward voltage drop $V_F$ of each of diodes 42 and 44 is chosen to be equal to base-emitter voltage $V_{BE}$, equation (1) may be rewritten as follows:

$$I_E=V_F/R_{38} \quad (2)$$

The current capable of flowing from terminal 30 has the same order of magnitude as the first current, $I_E$, expressed by equation (2). However, the first current $I_E$ drifts with temperature because the tempeature coefficient for each of diodes 42 and 44 is about −2 m V/°C. and for resistor 38 is about 2500PPM/°C. if it is a diffusion resistor. Consequently, a constant current is not obtained by the conventional current source described above.

Figure 2:
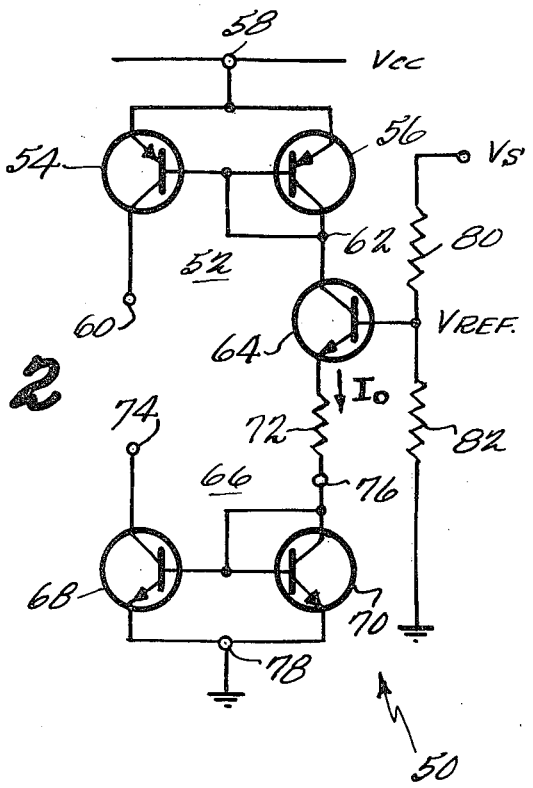
FIG. 2 is one embodiment of the current stabilizing circuit of the present invention.

FIG. 2 shows a current stabilizing circuit 50 in accordance with the present invention which includes a current mirror 52, consisting of a pair of identical p-n-p transistors 54 and 56. Current mirror 52 has three terminals 58, 60 and 62. Sum terminal 58, from the emitters of transistors 54 and 56, is connected to a power source $V_{CC}$. The base of transistor 54 is connected to the base of transistor 56. Transistor 56 operates as a diode in that its base and collector are interconnected. The collector of transistor 56 is connected to terminal 62 so that its emitter-collector path constitutes a current path between terminals 58 and 62. Similarly, the collector-emitter path of transistor 54 constitutes a current path between terminals 58 and 60.

Terminal 62 is further connected to a n-p-n transistor 64, specifically to the collector thereof. The emitter of transistor 64 is connected to a current mirror 66, consisting of a pair of identical n-p-n transistors 68 and 70, through a resistor 72. Current mirror 66 has three terminals 74, 76 and 78. Sum terminal 78, from the emitters of transistors 68 and 70, is grounded.

A power source $V_S$ is connected to a series circuit of resistors 80 and 82. The base of transistor 64 is connected between resistors 80 and 82. The base potential $V_{REF}$ of transistor 64 is expressed by the following equation:

$$V_{REF}=R_{82}\cdot V_S/(R_{80}+R_{82}) \quad (3)$$

where $R_{80}$ and $R_{82}$ are the values of resistors 80 and 82 respectively. Accordingly, the emitter current, designated $I_o$, flowing from transistor 64, is expressed as follows:

$$I_o=(V_{REF}-V_{BE64}-V_{BE70})/R_{72} \quad (4)$$

where $V_{BE64}$ and $V_{BE70}$ are the base-emitter voltages of transistors 64 and 70, respectively, and $R_{72}$ is the value of resistor 72. For common emitter current flowing through both transistors 64 and 70, the following equation is substituted in equation (4):

$$V_{BE64}=BE70 \quad (5)$$

As the result, equation (4) may be rewritten as follows:

$$I_o=(V_{REF}-2V_{BE64})/R_{72} \quad (6)$$

The partial derivative of $I_o$ with respect to temperature is given as follows:

$$\frac{\Delta I_o}{\Delta T} = \frac{-1}{R_{72}}\left[2\frac{\Delta V_{BE64}}{\Delta T} + (V_{REF} - 2V_{BE64})\frac{1}{R_{72}}\frac{\Delta R_{72}}{\Delta T}\right] \quad (7)$$

The temperature coefficient of the base-emitter voltage of transistor 64

$$\left(\frac{\Delta V_{BE64}}{\Delta T}\right)$$

is about −2 m V/°C. and that of resistor 72

$$\left(\frac{1}{R_{72}}\cdot\frac{\Delta R_{72}}{\Delta T}\right)$$

is about 2500 PPM/°C. when the resistor is a diffusion resistor. Thus:

$$\frac{\Delta V_{BE64}}{\Delta T} \simeq -0.002 \quad (8)$$

$$\frac{1}{R_{72}}\cdot\frac{\Delta R_{72}}{\Delta T} \simeq 0.0025 \quad (9)$$

so that $I_o$ is temperature independent, $\Delta I_o/\Delta T$ must be zero.

$$\frac{\Delta 2V_{BE64}}{\Delta T} + (V_{REF} - 2V_{BE64})\frac{1}{R_{72}}\cdot\frac{\Delta R_{72}}{\Delta T} = 0 \quad (10)$$

By substituting equations (8) and (9) in equation (10), equation (10) may be rewritten as follows:

$$V_{REF} - 2V_{BE64} = 1.6 \quad (11)$$

If base-emitter voltage $V_{BE64}$ of transistor 64 is assumed to be 0.7 volts, base potential $V_{REF}$ must be 3 volts. Thus, by adjusting base potential $V_{REF}$ to 3 volts, emitter current $I_o$, flowing in transistor 64, becomes constant and independent with respect to temperature.

Having included current mirrors 52 and 66, a constant and temperature independent current, which is of the same order of magnitude as $I_o$, can flow from terminal 60 and can flow into terminal 74.

Figure 3:
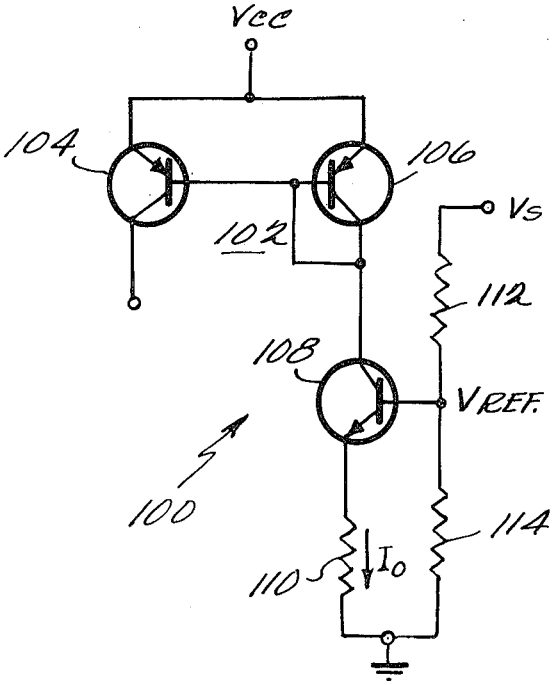
FIG. 3 is another embodiment of the current stabilizing of the present invention.

FIG. 3 shows an alternative current stabilizing circuit in accordance with the present invention designated by numeral 100. This circuit is similar to circuit 50, except that it excludes current mirror 66 so that a detailed explanation is not necessary. Stabilizing circuit 100 includes a current mirror 102 consisting of a pair of identical p-n-p transistors 104 and 106. The collector of transistor 106 is connected to a n-p-n transistor 108, specifically the collector thereof. The emitter of transistor 108 is grounded through a resistor 110. The power source $V_S$ is applied to serially connected resistors 112 and 114. The base of transistor 108 is connected between resistors 112 and 114. The emitter current $I_o$ flowing from transistor 108 is expressed similar to equation (11), that is:

$$I_o = (V_{REF} - V_{BE108})/R_{110} \quad (12)$$

The partial derivative of $I_o$ with respect to temperature is given as follows:

$$\frac{\Delta I_o}{\Delta T} = -\frac{1}{R_{110}}\left[\frac{\Delta V_{BE108}}{\Delta T} + (V_{REF} - V_{BE108})\frac{1}{R_{110}}\frac{\Delta R_{110}}{\Delta T}\right] \quad (13)$$

For $I_o$ to be independent of temperature, the following equation must be satisfied:

$$\frac{\Delta V_{BE108}}{\Delta T} + (V_{REF} - V_{BE108})\frac{1}{R_{110}}\frac{\Delta R_{110}}{\Delta T} = 0 \quad (14)$$

Substituting equations (8) and (9) in equation (14), the following relationship between $V_{REF}$ and $V_{BE108}$ is indicated, namely:

$$V_{REF} - V_{BE108} = 0.8 \quad (15)$$

If the base-emitter voltage $V_{BE108}$ of transistor 108 is assumed to be 0.7 volts, the base potential, $V_{REF}$ must be 1.5 volts.

Accordingly, an emitter current $I_o$ which is constant and temperature independent is obtained of base potential $V_{REF}$ is adjusted to 1.5 volts. The same order of magnitude of current as emitter current $I_o$ may be delivered from the collector of transistor 104 in current mirror 102.

What is claimed is:

1. A current stabilizing circuit comprising:

a current source including first and second terminals, the current flowing through said first terminal controlling the current that may flow through said second terminal;

a transistor circuit including a resistor and a transistor having a base and current conducting terminals, said resistor being connected in series with said current conducting terminals, said transistor circuit being connected to said first terminal; and means for controlling the current flowing through said base in relation to the temperature coefficients of said resistor and said transistor to cause the current that may flow through said second terminal to be constant and temperature independent.

2. A current stabilizing circuit comprising:

a current source including first and second terminals, the current flowing through said first terminal controlling the current that may flow through said second terminal;

a transistor circuit including a resistor and a transistor having a base and current conducting terminals, said resistor being connected in series with said current conducting terminals, said transistor circuit being connected to said first terminal;

means for controlling the current flowing through said base in relation to the temperature coefficients of said resistor and said transistor to cause the current that may flow through said second terminal to be constant and temperature independent; and another current source including third and fourth terminals, said third terminal being connected to said transistor circuit, the current flowing through said third terminal controlling the current that may flow through said fourth terminal.

3. A circuit as in claim 1 or 2 wherein said controlling means comprises second and third resistors connected in series, said transistor base being connected between said second and third resistors.

4. A current stabilizing circuit comprising:

a current source including first and second terminals, the current flowing through said first terminal controlling the current that may flow through said second terminal;

a transistor circuit including a resistor and a transistor having a base and current conducting terminals, said resistor being connected in series with said current conducting terminals, said transistor circuit being directly connected to said first terminal; and means for controlling the current flowing through said base in relation to the temperature coefficients of said resistor and said transistor to cause the current that may flow through said second terminal to be constant and temperature independent.

* * * * *